United States Patent [19]

Bruton

[11] 4,397,606

[45] Aug. 9, 1983

[54] ARTICLE HANDLING APPARATUS AND METHOD FOR RESTOCKING STORE SHELVES

[76] Inventor: Rose L. Bruton, P.O. Box 621, Delta, Colo. 81416

[21] Appl. No.: 215,158

[22] Filed: Dec. 11, 1980

[51] Int. Cl.[3] ..... A47F 3/06

[52] U.S. Cl. ..... 414/786; 108/65; 211/134; 220/23.4; 312/119; 414/787

[58] Field of Search ..... 414/786, 787; 108/65, 108/69; 211/49 R, 88, 126, 134; 312/119, 120, 126, 183, 322; 206/558; 220/234

[56] References Cited

U.S. PATENT DOCUMENTS

| | | | |
|---|---|---|---|
| 1,472,129 | 10/1923 | Meixell | 108/69 |
| 3,834,778 | 9/1974 | Morrison et al. | 211/126 X |
| 4,034,864 | 7/1977 | Tyson et al. | 211/126 X |

*Primary Examiner*—Robert G. Sheridan
*Attorney, Agent, or Firm*—Ancel W. Lewis, Jr.

[57] ABSTRACT

An article handling apparatus and method is provided that is particularly suited for restocking store shelves with a variety of articles. The articles (16) are supported in a plurality of like trays (17) that are arranged side by side. A caddy shelf (18) has a rear portion that slidably inserts at different lateral positions into a slot formed between a display shelf (13) and shelf cover (39) to be supported in a cantilever manner. A forward portion of the shelf caddy supports one or more of the trays after they have been removed from the display shelf, permitting the user to inspect the removed articles, face the articles forward and easily rotate articles of merchandise for freshness in restocking the removed tray, and then slide the tray back onto the display shelf and remove the caddy shelf.

15 Claims, 7 Drawing Figures

ARTICLE HANDLING APPARATUS AND METHOD FOR RESTOCKING STORE SHELVES

TECHNICAL FIELD

This invention relates generally to the article handling art and more particularly to a novel and improved apparatus and method for readily handling articles on store shelves and is especially suited for inspection, restocking and like purposes.

BACKGROUND ART

The matter of ready access to, a full visual inspection of, and the restocking of articles on conventional store shelves poses a time consuming problem. This is particularly true for small items such as spices, pharmaceuticals and the like. Some prior art shelves have been provided with pull-out auxiliary shelves, but this is usually not the case with store shelves that are used for display of spice, pharmaceuticals and like small articles. Some attempts have been made to mount shelf extensions onto a store shelf for display purposes, as is shown in U.S. Pat. No. 2,891,679, but these project out into the aisle during customer selection rather than being removed during usual customer traffic, and by themselves do not provide a ready removal and/or replacement of a number of relatively small articles at one time.

DISCLOSURE OF INVENTION

In accordance with the present invention a caddy shelf is detachably mounted to the display shelf and extends forwardly of the display shelf providing a horizontal support surface on which articles in a specially constructed article container are supported. In use each article container is pulled out from the shelf and onto the caddy shelf. The mounting for the caddy shelf is provided by the positioning of a shelf cover prior to the initial placement of the trays thereon and the formation of an insert slot between the display shelf and the shelf cover into which the rear end of the caddy shelf is releasably inserted. The rear portion of the caddy shelf is preferably of a sheet metal such as stainless steel with longitudinally extending ribs for strength and durability. This combination of the shelf modification, caddy shelf and article container provides a method of handling a plurality of articles wherein one or more article containers are placed on the caddy shelf, the articles inspected, counted and restocked if necessary and then are returned to the display shelf, after which the shelf caddy is removed from the display shelf so as not to interfere with usual customer traffic in the store.

BRIEF DESCRIPTION OF DRAWINGS

The details of this invention will be described in connection with the accompanying drawings, in which.

DETAILED DESCRIPTION

Figure 1:
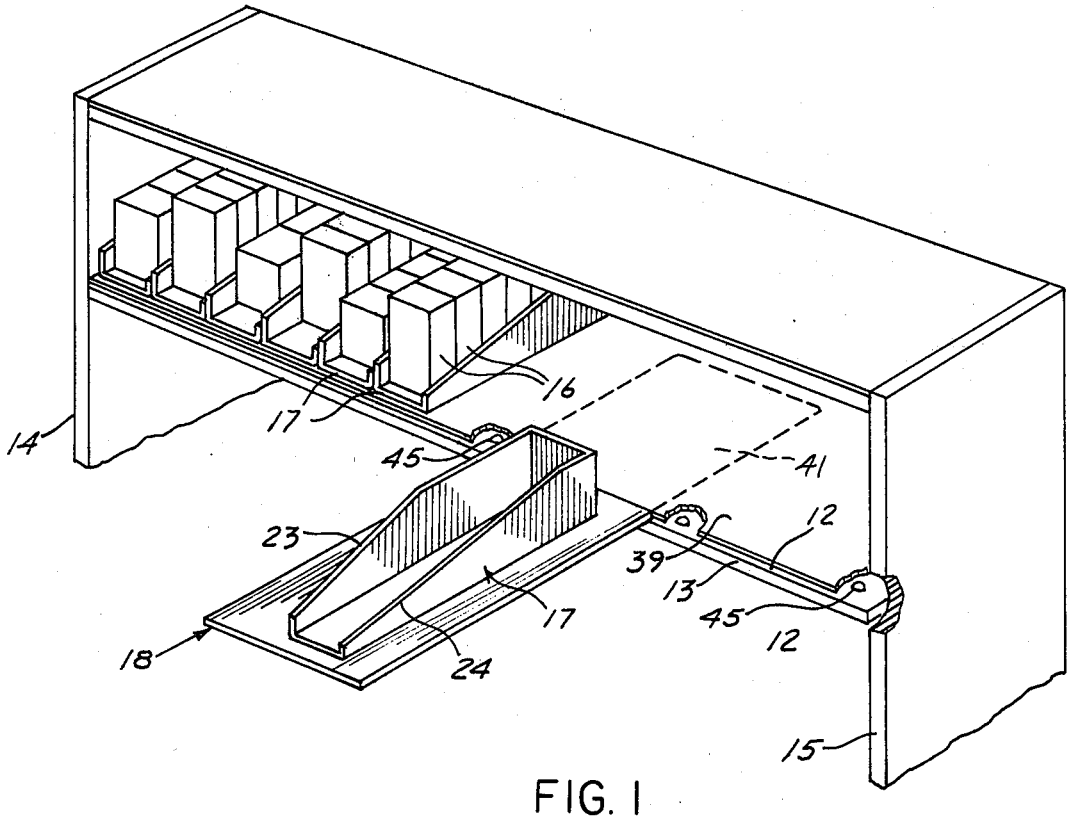
FIG. 1 is a perspective view of a combination store shelf and article handling apparatus according to the present invention with portions of the display shelf broken away to show interior parts.
Figure 2:
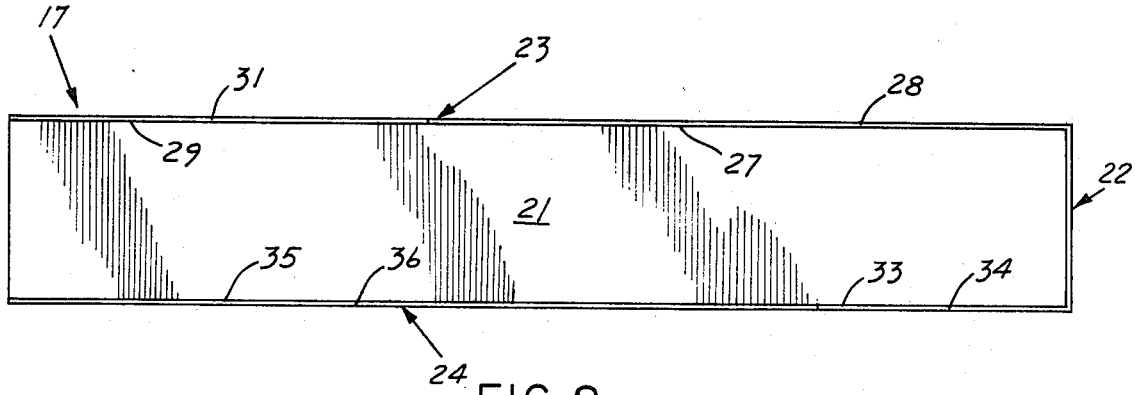
FIG. 2 is a top plan view of the article tray shown in FIG. 1.
Figure 3:
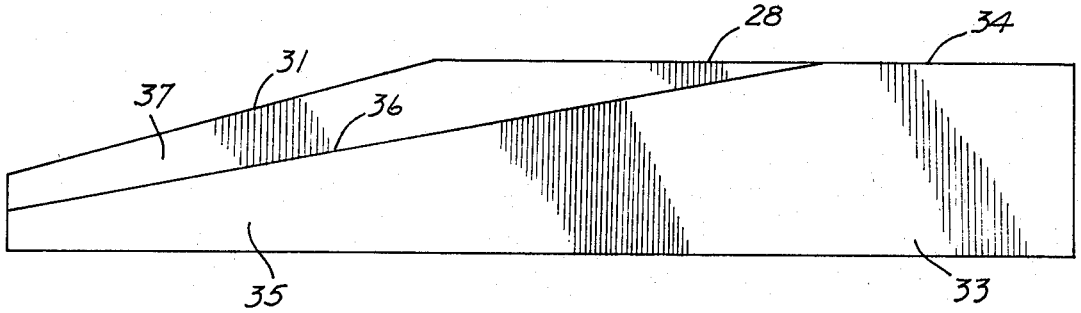
FIG. 3 is a side elevation view of the article tray of FIG. 2.
Figure 4:
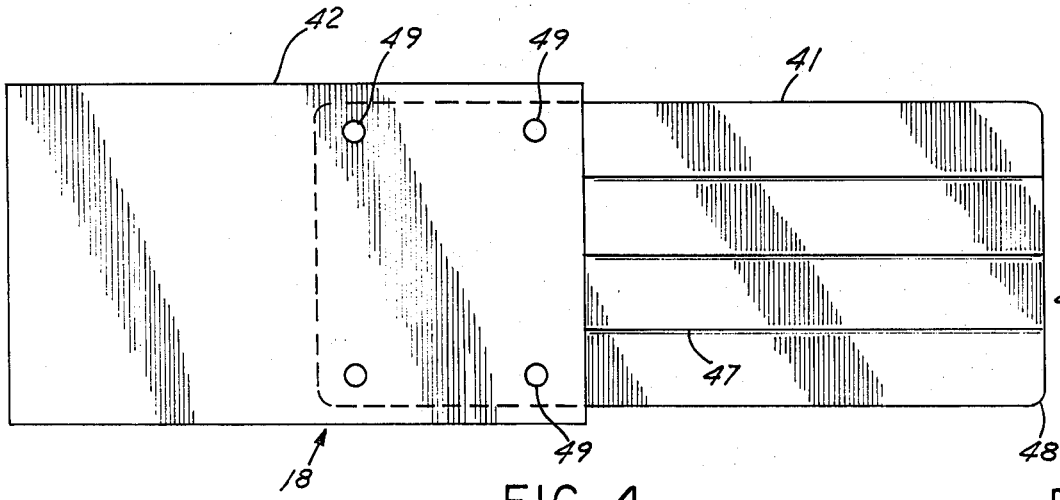
FIG. 4 is a top plan view of the demountable tray supporting caddy shelf shown in FIG. 1.
Figure 5:
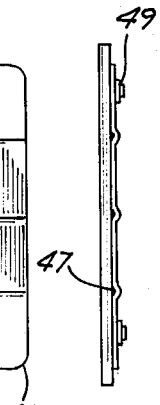
FIG. 5 is an end elevation view of the caddy shelf shown in FIG. 4.
Figure 6:
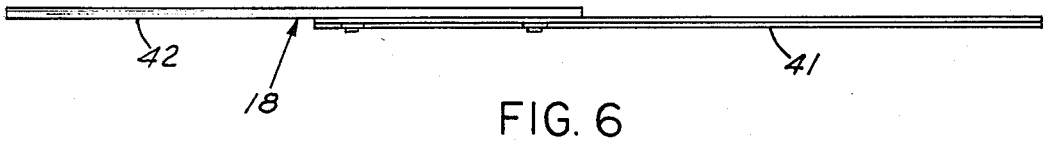
FIG. 6 is a side elevation view of the caddy shelf shown in FIG. 4.
Figure 7:
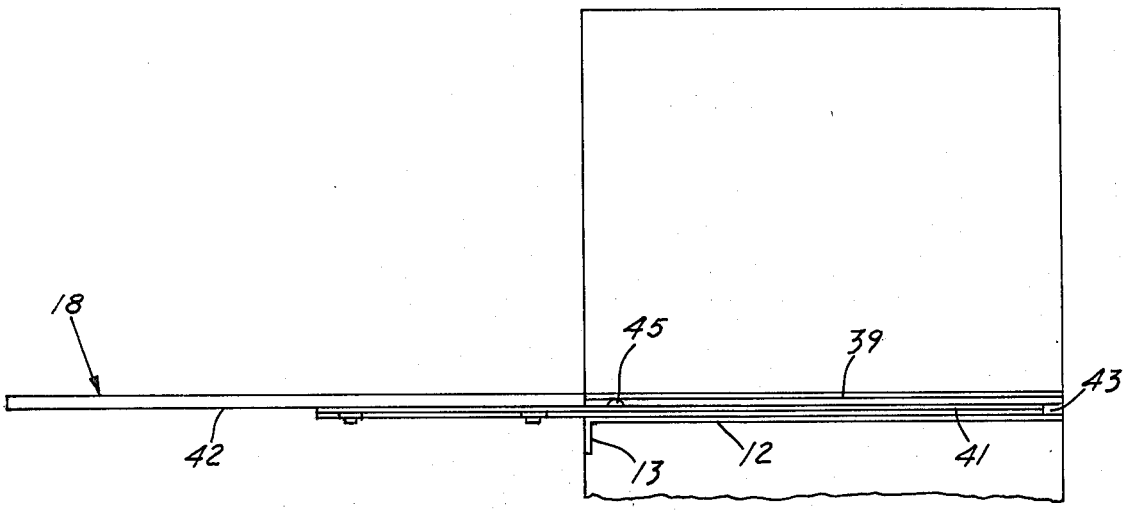
FIG. 7 is a side elevation view showing the caddy shelf supported by the display shelf with one end wall of the shelf assembly removed to show interior parts.

Referring now to the drawings, in FIGS. 1 and 7 there is represented a store shelf assembly including a conventional store display shelf 12 with a downturned tag strip 13 and a pair of opposed parallel-spaced sidewalls 14 and 15 supporting the shelf in a horizontal position. A plurality of stock articles 16 are shown arranged in a plurality of article containers 17 in the form of trays arranged side by side and supported by the display shelf 12. One article container 17 is shown in a removed position on a caddy shelf 18. The caddy shelf 18 is detachably mounted to and projects forwardly of the display shelf 12 in a position in line with the article container to be removed that is readily accessible to the user to permit articles in the removed tray 17 to be visually inspected, faced forwardly allowing fresh merchandise to be rotated easily, counted for inventory, and replaced after being restocked, as desired.

In the apparatus shown in FIG. 1, the article container 17 is generally box-like having a flat bottom wall 21, an upright back 22 perpendicular to the bottom wall, and opposed upright parallel-spaced sidewalls 23 and 24 perpendicular to the bottom wall and defines a generally box-shaped article that is open at the front and top. The perpendicular sidewalls permit the containers 17 to butt against one another side by side on the display shelf for maximum utilization of shelf space. The left sidewall 23 as viewed from the front has a rear portion 27 of uniform height with a horizontal top edge 28 and a front portion 29 of varying height that extends forwardly and downwardly with an inclined top edge 31. The right sidewall 24 as viewed from the front has a rear portion 33 of uniform height with a horizontal top edge 34 and a front portion 35 of varying height with a forwardly and downwardly inclined top edge 36. The right sidewall 24 begins to taper closer toward the back wall and to a lower point relative to the base to form a forward wall portion 37 on the left sidewall that is higher than the right sidewall which serves as a gripping surface for the user.

This container 17 is preferably made of a durable material such as plastic which can be readily formed from a flat sheet into the tray-like open box shape shown. Container 17 preferably has a length substantially corresponding to the depth of the display shelf and a width considerably less than the length of the display shelf to permit a plurality of containers to be disposed side by side on the display shelf.

The caddy shelf 18 shown is in the form of a relatively thin, flat-sided sheet of material having a generally rectangular shape and has a rear insert portion 41 and a forward shelf portion 42 that provides a flat top surface area of a size sufficient to support at least one container 17. The rear insert portion 41 is preferably made of a rigid sheet metal such as a sheet of stainless steel formed with three laterally spaced longitudinal ribs 47 for added strength and has rounded corners 48 for safety. The forward shelf portion 42 shown is preferably made of a pressed board having a rear portion that overlays a front portion of the stainless steel portion 41 and is shown attached to the stainless steel portion 41 by means of four fasteners in the form of pop rivets 49. The thickness of the pressed board is preferably the same as the shelf cover.

A shelf cover 39 of relatively uniform thickness is shown superposed on the display shelf and a plurality of laterally spaced spacers 45 are provided between a forward bottom surface of the shelf cover 39 and the forward top surface of the display shelf to form an insert or receiving slot 43 into which the rear insert portion 41 of the caddy shelf 18 may readily be inserted and removed.

The spacers 45 are a distance apart related to the width of the insert portion 41 to permit the insert portion to insert therebetween. While only three spacers are shown in FIG. 1, it is preferred to have three more on the opposite side of the center of the shelf with similar spacing. The thickness of the spacers is related to the thickness of the rear insert portion to permit the rear insert portion to slidably insert between the shelf cover and the display shelf in a close or tight fitting relationship so as to be held firmly in place. A vertical thickness of $\frac{1}{8}$ inch for spacers 45 has been used and round top stove bolts that are threaded down into a hole in the display shelf have been found suitable. In practice it may be advantageous to fasten the rear end of the insert portion to the rear end of the display shelf by suitable fastening means such as threading a bolt down through both members.

By way of illustration and not limitation, the dimension of a caddy shelf and article container found suitable for this purpose is as follows:

| | |
|---|---|
| Width of rear sheet 41 | 8 inches |
| Length of rear sheet 41 | 19 inches |
| Width of front board 42 | 9 inches |
| Length of front board 42 | 15 inches |
| Overall length of caddy shelf 18 | 26.5 inches |
| Width of article container 17 | 2.5 inches |
| Height of back wall 22 | 2.5 inches |
| Height of raised section 37 | 0.5 inches |

In carrying out an article handling operation in accordance with the present invention, the rear insert portion 41 of the caddy shelf is inserted into the insert or receiving slot 43 between the shelf cover 39 and the display shelf 12 and is firmly supported in the manner of a cantilever. One or more selected article containers 17 containing store articles is removed and placed on the supporting surface of caddy shelf 18 and there the articles are inspected and replaced, or counted as in the case of an inventory situation and refilled if restocking is desired. The filled container is then replaced on the shelf cover and the caddy shelf removed so that there are no projecting surfaces forwardly of the display shelf.

INDUSTRIAL APPLICABILITY

It is apparent that the apparatus and method of the present invention provide a means whereby a number of small articles displayed on store shelves, such as spices, pharmaceuticals and the like, which are not readily counted or seen may be readily handled. Moreover, the use of containers for a plurality of the articles and the detachable caddy shelf facilitate the ready restocking of the display shelves.

The containers also permit a prepackaging of articles thereon for the manufacturer so that the manufacturer may furnish his goods in such containers, and the store may place the goods on the shelf without handling a large number of small articles.

Although the present invention has been described with a certain degree of particularity, it is understood that the present disclosure has been made by way of example and that changes in details of structure may be made without departing from the spirit thereof.

What is claimed is:

1. In apparatus for use in handling articles supported on a display shelf, the combination comprising:

a plurality of multiple article display containers having side walls for isolating juxtaposed article groupings and for stabilizing contained articles, supported side by side on said display shelf, each said container displaying in use, a plurality of free-standing, tippable articles in front-to-rear array; and a caddy shelf for supporting a selected of said containers removed from said display shelf, said caddy shelf being detachably mounted to and projecting forwardly of said display shelf and substantially in line with a selected article container that is to be removed, said caddy shelf being locatable at different positions laterally of said display shelf, whereby in use an article container on said display shelf is removed forwardly from said display shelf and supported on said caddy shelf forwardly on said display shelf and then repositioned rearwardly on said display shelf.

2. In apparatus as set forth in claim 1 wherein said article container has a length substantially corresponding to the depth of the display shelf, said article container being in the form of a generally U-shaped tray open at the front and at the top, said tray having a flat bottom wall, an upright back wall perpendicular to said bottom wall and wherein said side walls are upright, opposed parallel-spaced and perpendicular to said bottom wall defining a generally box-shaped article receiving cavity.

3. In apparatus as set forth in claim 2 wherein a portion of one of said sidewalls is of greater height than an opposite portion of the other sidewall to provide a gripping surface for grasping by the user.

4. In apparatus as set forth in claim 3 wherein each of said sidewalls have a rear portion of uniform height with a horizontal top edge and a front portion of varying height with a downwardly and forwardly inclined top edge.

5. In apparatus as set forth in claim 1 wherein said caddy shelf is in the form of a relatively thin, flat-sided sheet of material having a generally rectangular shape, said sheet of material having a flat top surface area of a size sufficient to support at least one article container.

6. In apparatus as set forth in claim 5 wherein said caddy shelf includes a rear insert portion made of a sheet metal with rounded corners that overlaps the display shelf and a front shelf portion having smooth flat parallel-spaced top and bottom surfaces, said front shelf portion projecting forwardly of the display shelf and supported in the manner of a cantilever.

7. In apparatus suitable for restocking articles on a display shelf, the combination comprising:

a shelf cover superposed on said display shelf;

spacing means at the forward edge of said display shelf and shelf cover forming slot means therebetween;

a plurality of article trays arranged side by side on said shelf cover; and a detachable caddy shelf arranged to releasably mount at different positions laterally of said display shelf and extending forwardly of said display shelf, said caddy shelf having a rear insert portion releasably inserted into said slot means and a front shelf portion providing a substantially horizontal support surface for an article tray removed from said shelf cover, whereby each article tray may be removed from the shelf cover and supported on the caddy shelf forwardly of its position on the display shelf for restocking articles in the removed article tray and then repositioned on said display shelf.

8. In apparatus as set forth in claim 7 wherein said shelf cover is in the form of a relatively thin sheet material of uniform thickness throughout and substantially corresponds in external shape to the upper horizontal surface of the display shelf on which said cover is supported.

9. In apparatus as set forth in claim 8 wherein said spacing means is in the form of a plurality of spacers mounted on said display shelf and spaced a sufficient distance from one another to permit the rear insert portion of said caddy shelf to slidably insert between said cover and said display shelf in a close fitting relationship and also fits between each pair of adjacent spacers.

10. In apparatus as set forth in claim 8 wherein said caddy shelf includes a rear insert portion made of a rigid sheet metal with rounded corners and a forward shelf portion having top and bottom flat planar surfaces and being made of a smooth-surfaced non-metal board of substantially the same thickness as said shelf cover.

11. In apparatus as set forth in claim 10 wherein said rear insert portion is a sheet of stainless steel having a plurality of laterally spaced longitudinal ribs for added strength and said front shelf portion is a sheet of pressed particle board having a portion overlapping a portion of said sheet of stainless steel and held to said stainless steel by fasteners.

12. A method of handling freestanding, tippable articles disposed in freestanding position on a display shelf comprising the steps of:

disposing a plurality of removable article containers having opposite side walls side by side on a display shelf to display the articles in front-to-rear array while in the containers to isolate juxtaposed article groupings and to stabilize contained article groupings;

releasably attaching a caddy shelf with a horizontal supporting surface of a size suitable for supporting at least one of said article containers to the display shelf to extend forwardly of said display shelf and forwardly of the article container to be removed;

removing said article container forwardly from said display shelf and positioning it on said shelf caddy; and replacing said article container rearwardly on said display shelf.

13. A method of handling articles as set forth in claim 12 including the further step of restocking said removed article container with the desired number of articles prior to replacing it on the display shelf.

14. A method of rotationally restocking display shelves with a plurality of freestanding, tippable articles comprising the steps of:

disposing a plurality of removable article trays arranged side by side on a display shelf to display the articles in front-to-rear array while in the trays;

releasably attaching a caddy shelf to the display shelf forwardly of said display shelf and forwardly of a selected article tray to be removed;

removing at least one of said article trays forwardly from said shelf and positioning said removed tray on said caddy shelf;

advancing residual articles forwardly in the tray;

restocking the removed tray with the desired number of articles to the rear of the tray; and replacing the restocked tray rearwardly on said display shelf.

15. A method as set forth in claim 14 wherein in releasably attaching said caddy shelf to said display shelf a rear portion of said caddy shelf is inserted in a slot between the upper surface of the shelf and a shelf cover superposed on and spaced from said display shelf.

* * * * *